US009903599B2

(12) United States Patent
Bass et al.

(10) Patent No.: US 9,903,599 B2
(45) Date of Patent: Feb. 27, 2018

(54) COVER WITH INTEGRATED FUNNEL

(71) Applicant: J.L. Wingert Company, Garden Grove, CA (US)

(72) Inventors: Robert Bass, Signal Hill, CA (US); Hratch Nuyujukian, Yorba Linda, CA (US)

(73) Assignee: J.L. Wingert Company, Garden Grove, CA (US)

( * ) Notice: Subject to any disclaimer, the term of this patent is extended or adjusted under 35 U.S.C. 154(b) by 59 days.

(21) Appl. No.: 14/994,862

(22) Filed: Jan. 13, 2016

(65) Prior Publication Data

US 2016/0257459 A1 Sep. 8, 2016

(51) Int. Cl.
*B67C 3/30* (2006.01)
*F24D 3/10* (2006.01)

(52) U.S. Cl.
CPC ..... *F24D 3/1083* (2013.01)

(58) Field of Classification Search
CPC ..... F24D 3/1083; B67C 11/00; B67C 11/02; B67C 11/20
See application file for complete search history.

(56) References Cited

U.S. PATENT DOCUMENTS 3,779,157 A 12/1973 Ross, Jr. et al.
4,112,984 A 9/1978 Guglia et al.
4,934,553 A * 6/1990 McCarthy ..... B65D 90/041 220/565
5,033,520 A * 7/1991 Kuehmichel ..... B65F 1/1468 141/231
5,273,083 A 12/1993 Burrows
5,316,059 A * 5/1994 Lahnan ..... B67C 11/02 141/331
5,402,835 A * 4/1995 Middleton ..... B67C 11/00 141/331
D403,642 S 1/1999 Acord
6,152,198 A * 11/2000 Nguyen ..... B67C 11/02 141/337

(Continued)

FOREIGN PATENT DOCUMENTS

CN 2062984 U 10/1990
CN 2343106 Y 10/1999

(Continued)

OTHER PUBLICATIONS

Canadian Intellectual Property Office Examination Search Report, dated Jan. 11, 2017, for Patent Application No. 2,918,164, 3 pages.

*Primary Examiner* — Nicolas A Arnett
(74) *Attorney, Agent, or Firm* — Lewis Roca Rothgerber Christie LLP

(57) ABSTRACT

A fluid feed system cover with an integrated funnel. A fluid feed system includes a reservoir and equipment installed on a top surface of the reservoir. The top surface of the reservoir also has a fill hole for replenishing the reservoir. A cover is installed on top of the reservoir, protecting the equipment. A funnel integrated into the cover extends into, or to just above, the reservoir fill hole, making it possible to replenish the reservoir without removing the cover. A manway is used to cover the upper opening of the funnel when reservoir replenishment is complete.

17 Claims, 5 Drawing Sheets

(56) References Cited

U.S. PATENT DOCUMENTS

| | | | | |
|---|---|---|---|---|
| 6,446,827 | B1 * | 9/2002 | Akins | B44D 3/12 220/570 |
| 6,568,440 | B1 | 5/2003 | Engelbrecht | |
| 6,786,255 | B1 | 9/2004 | Lee | |
| 6,837,283 | B1 | 1/2005 | Wegner | |
| 7,264,027 | B2 | 9/2007 | Rosenbaum | |
| 9,505,599 | B2 * | 11/2016 | Marantis | B67C 11/00 |
| 9,517,922 | B2 * | 12/2016 | Marantis | A61J 1/14 |
| 2004/0200856 | A1 * | 10/2004 | Cho | B65D 51/2864 222/129 |
| 2008/0023103 | A1 * | 1/2008 | Ballinger | B67C 11/00 141/338 |
| 2008/0295915 | A1 | 12/2008 | Kim | |
| 2016/0136048 | A1 * | 5/2016 | Marantis | A61M 1/0003 141/331 |
| 2016/0137474 | A1 * | 5/2016 | Marantis | A61J 1/14 141/331 |

FOREIGN PATENT DOCUMENTS

| | | | |
|---|---|---|---|
| CN | 101554250 | A | 10/2009 |
| CN | 201641843 | U | 11/2010 |
| CN | 201649223 | U | 11/2010 |
| CN | 101898506 | A | 12/2010 |
| CN | 202194183 | U | 4/2012 |
| CN | 102848907 | A | 1/2013 |
| CN | 203183770 | U | 9/2013 |
| DE | 20 2006 009 1 | | 4/2007 |

* cited by examiner

COVER WITH INTEGRATED FUNNEL

CROSS-REFERENCE TO RELATED APPLICATION(S)

The present application claims priority to and the benefit of U.S. Provisional Application No. 62/128,350 filed Mar. 4, 2015, entitled "COVER WITH INTEGRATED FUNNEL", the entire content of which is incorporated herein by reference.

FIELD

One or more aspects of embodiments according to the present invention relate to fluid feed systems, and more particularly to a system for replenishing a reservoir of a fluid feed system.

BACKGROUND

When a system with a reservoir requires periodic refilling with fluid, the refilling process may be inconvenient and vulnerable to spills, especially if access constraints make it difficult to bring the mouth of a container of fluid close to the reservoir's fill port. The problem may be exacerbated by the presence of equipment on top of the reservoir, which may obstruct access, and which may be at risk of being damaged by any spilled fluid. Moreover, if a cover is installed over the equipment during operation, it may be necessary to remove it to fill the reservoir. A funnel may be used to fill a reservoir in such a situation, but the use of a funnel may be inconvenient. If cleanliness of the fluid is important, for example, it may be necessary to clean the funnel before each use. In some circumstances it may be necessary for a service technician replenishing the reservoir to support the funnel with one hand while pouring the fluid with the other, an operation that may be difficult if the container of fluid is large or heavy, and that may carry a risk of exposing the hand supporting the funnel to spilled fluid. Thus there is a need for a convenient system for filling a reservoir, especially in situations in which the reservoir has top-mounted equipment protected by a cover.

SUMMARY

Aspects of embodiments of the present disclosure are directed toward a fluid feed system cover with an integrated funnel. A fluid feed system includes a reservoir and equipment installed on a top surface of the reservoir. The top surface of the reservoir also has a fill hole for replenishing the reservoir. A system cover is installed on top of the reservoir, protecting the equipment. A funnel integrated into the system cover extends into, or to just above, the reservoir fill hole, making it possible to replenish the reservoir without removing the system cover. A funnel cover is used to cover the upper opening of the funnel when reservoir replenishment is complete.

According to an embodiment of the present invention there is provided a system cover for a reservoir of a fluid feed system, the reservoir having a fill hole, the system cover including: a funnel, the funnel having an upper opening at an upper surface of the system cover, and a lower opening, wherein the funnel mates with the fill hole to receive fluid poured through the upper opening and to guide the fluid through the fill hole.

In one embodiment, the system includes a funnel cover covering the upper opening of the funnel.

In one embodiment, the system includes a seat secured to the system cover at the upper opening of the funnel, the seat engaging and securing the funnel cover.

In one embodiment, the seat includes an internal thread and the funnel cover includes an external thread engaging the internal thread of the seat.

In one embodiment, the seat is secured to the system cover with a plurality of threaded fasteners.

In one embodiment, the seat is an integral part of the system cover.

In one embodiment, the funnel cover is a tapered plug that fits into the upper opening of the funnel.

In one embodiment, the funnel cover has a vent providing an air path from an upper side of the funnel cover to a lower side of the funnel cover.

In one embodiment, a cross-sectional area of the upper opening of the funnel is greater than a cross-sectional area of the lower opening of the funnel.

In one embodiment, a portion of the funnel is a hollow truncated cone.

In one embodiment, the funnel is an integral part of the system cover.

In one embodiment, the system cover includes, as a major component, a material selected from the group consisting of linear low-density polyethylene, high-density polyethylene, and polypropylene.

In one embodiment, the system includes a horizontal shelf that abuts against a horizontal surface of the reservoir.

In one embodiment, the system includes a skirt that abuts against a side surface of the reservoir.

According to an embodiment of the present invention there is provided a fluid feed system, including: a reservoir having an upper surface and a fill hole in the upper surface; and a system cover, the system cover including a funnel, the funnel having an upper opening at an upper surface of the system cover, and a lower opening, the lower opening being above the fill hole or inside the reservoir when the cover is installed on the reservoir.

In one embodiment, the system includes: equipment secured to the upper surface of the reservoir, wherein the system cover has a window configured to provide access to the equipment.

In one embodiment, the system includes: an electrical cable or a fluid line, wherein the system cover further includes a connection channel, and the electrical cable or fluid line passes through the connection channel.

In one embodiment, the lower opening of the funnel is inside the reservoir.

In one embodiment, the system includes rubber edge trim on the edge of the fill hole of the reservoir.

According to an embodiment of the present invention there is provided a system cover for a reservoir of a fluid feed system, the reservoir having a fill hole, the system cover including: a funnel, the funnel having an upper opening at an upper surface of the system cover, and a lower opening, the lower opening being above the fill hole or inside the reservoir when the cover is installed on the reservoir.

BRIEF DESCRIPTION OF THE DRAWINGS

These and other features and advantages of the present invention will be appreciated and understood with reference to the specification, claims and appended drawings wherein:

The drawings are to scale for one embodiment.

DETAILED DESCRIPTION

The detailed description set forth below in connection with the appended drawings is intended as a description of exemplary embodiments of a cover with integrated funnel provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Hydronic systems may be used for various residential and commercial purposes, including, for example, for heating or cooling buildings, or for melting snow. A hydronic system for heating a building, and for removing snow from a surface, may be a closed-loop system containing a fluid, with a heat exchanger for heating the fluid, a serpentine pipe under the surface from which snow is to be removed, heat exchangers for heating the building, a circulation pump, and additional pipes for carrying the fluid between the other components of the system. The fluid may be ethylene glycol or polyethylene glycol (referred to collectively as "glycol").

The fluid pressure may be kept within a working pressure range, to prevent air from leaking into the system and to prevent the fluid from boiling. Small leaks may result in a gradual loss of fluid from the system, or the internal volume of the system may change if the pipes expand or contract with changes in temperature; in either case a deficit of fluid in the system may result. Such a deficit may be remedied by adding fluid with a fluid feed system.

Figure 1:
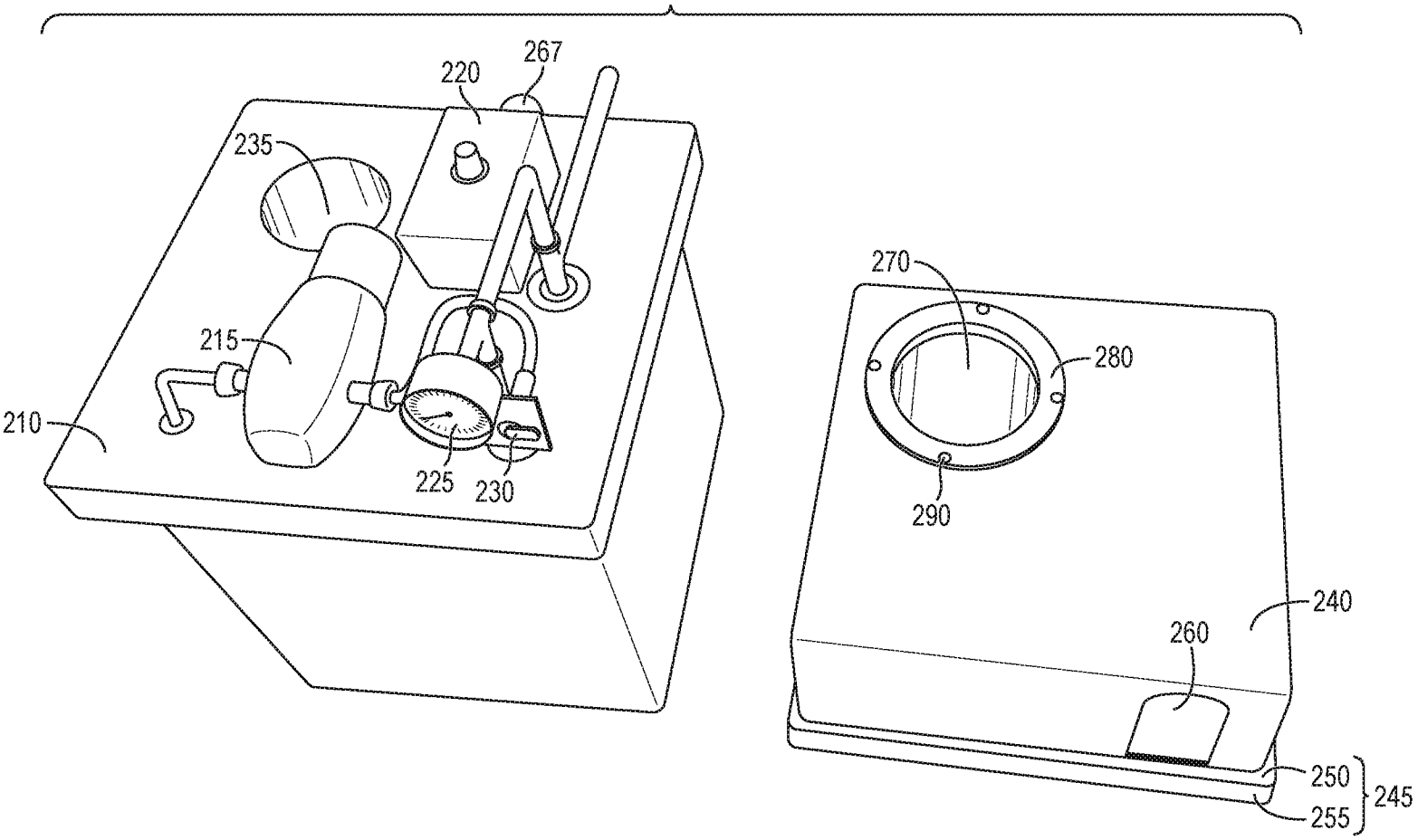
FIG. 1 is a perspective view of a fluid feed system with the system cover removed, according to an embodiment of the present invention.

Referring to FIG. 1, in one embodiment a fluid feed system (which may be a glycol feed system or a "glycol feeder") includes a reservoir 210, a pump 215, an electrical junction box 220, a pressure gauge 225, and a mode-select valve 230. The pump 215 may have an integrated pressure switch in fluid communication with the outlet of the pump 215. In normal operation, the pump outlet is connected to the hydronic system, and the pump inlet is connected to a pickup tube extending into the reservoir 210. When the system pressure drops to the lower threshold of the pressure switch, the pressure switch closes, energizing the pump 215, which pumps fluid from the reservoir 210 into the hydronic system. The pump 215 operates until the system pressure reaches the upper threshold of the pressure switch, at which point the pressure switch opens and the pump 215 shuts off. The pump 215 may be a low-flow, high-pressure pump such as a gear pump. The system may include a three-way mode-select valve 230 that may be used to select between normal operation, a feed system shut-off mode, and a mixing mode, in which the pump outlet is connected to a reservoir return pipe so that when the pump 215 operates, fluid is drawn up the pickup tube and returned to the reservoir 210, causing the fluid to be mixed.

The reservoir 210 may be a plastic container substantially in the shape of a box (i.e., a rectangular parallelepiped) with a top surface that is square or rectangular. In other embodiments, the reservoir 210 has a different shape, e.g., it may be cylindrical, with a circular top surface. Equipment, such as the pump 215, electrical junction box 220, pressure gauge 225, and mode-select valve 230, is mounted on top of, and secured to the top surface of, the reservoir 210. The top surface of the reservoir 210 also has a fill hole 235 for replenishing the fluid in the reservoir 210.

A system cover 240 protects the equipment on the reservoir 210 during operation. The system cover 240 has the shape of a shallow box with an open bottom, and a lip 245 extending along the lower edge of each wall, the lip 245 including a shelf 250 that abuts against the top surface of the reservoir 210 to support the weight of the system cover 240, and a skirt 255 that serves to align the system cover 240 with the reservoir 210 when the system cover 240 is installed. The system cover 240 has a window 260 providing access to the pressure gauge 225 and the mode-select valve 230, two connection channels 265 (FIG. 2), and an integrated funnel 270 covered by a funnel cover, or "manway" 275 (FIG. 2) that fits into a manway seat 280 secured, with threaded fasteners 290, to the system cover 240. The reservoir 210 may be replenished, while the system cover 240 is installed on the reservoir 210, by removing the manway 275 and pouring fluid into the integrated funnel 270, which guides fluid into the reservoir 210 through the fill hole 235 during the replenishment process. In FIG. 1 the manway 275 has been removed and is not shown.

Figure 2:
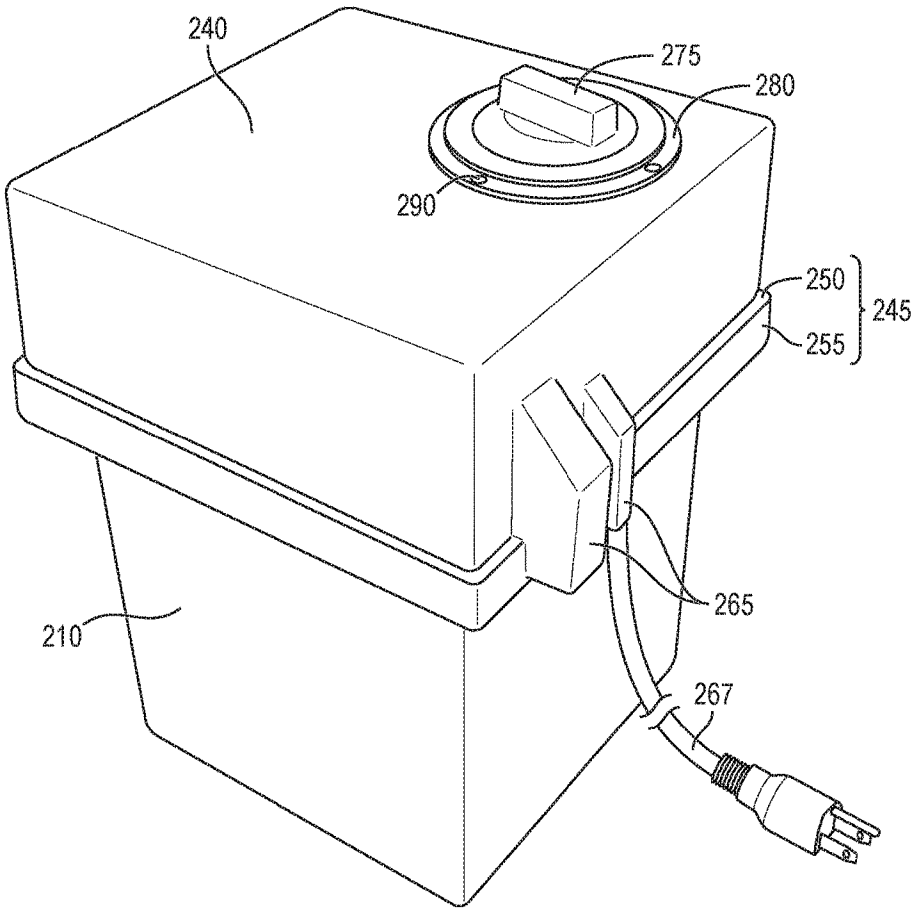
FIG. 2 is a perspective view of a fluid feed system, according to an embodiment of the present invention.

FIG. 2 shows the fluid feed system, including the reservoir 210 and the system cover 240, which is installed on the reservoir 210, covering and protecting equipment mounted on the reservoir 210. The connection channels 265 provide access for a power wire 267 to be connected to the electrical equipment under the system cover 240, and for a flexible line to be connected from the hydronic system to the fluid-handling equipment under the system cover 240. In FIGS. 1 and 2 the flexible line is not connected and is not shown. The perspective view of FIG. 2 is taken from a different angle than that of FIG. 1, so that, for example, the connection channels 265 that are hidden from view in FIG. 1 are visible in FIG. 2.

Figure 3:
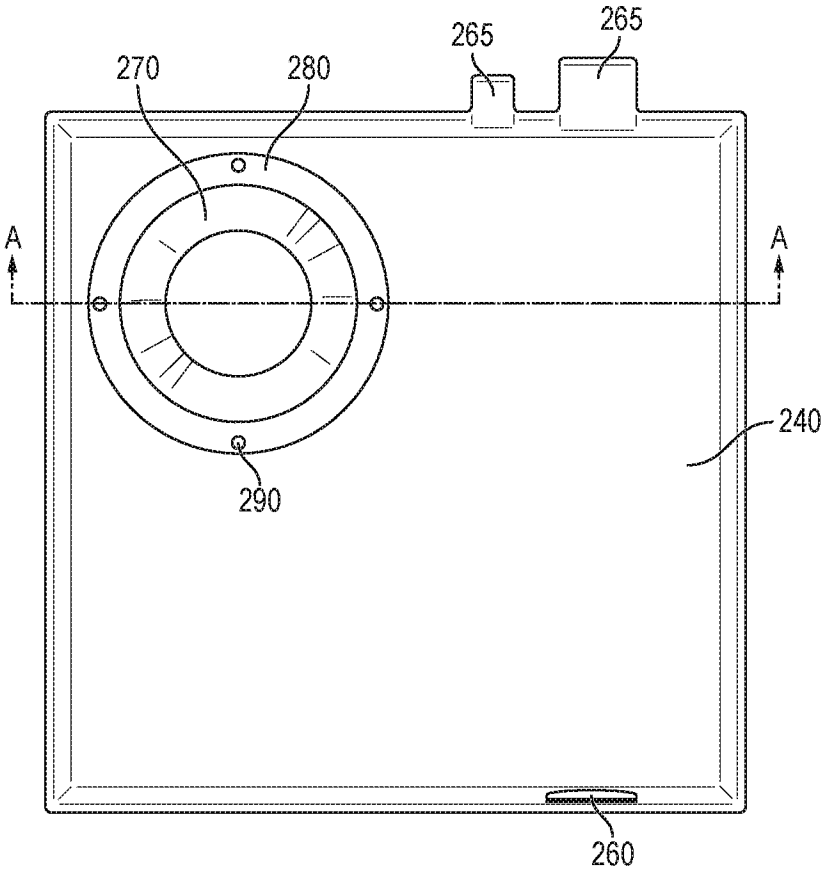
FIG. 3 is a top view of a fluid feed system cover, according to an embodiment of the present invention.
Figure 4:
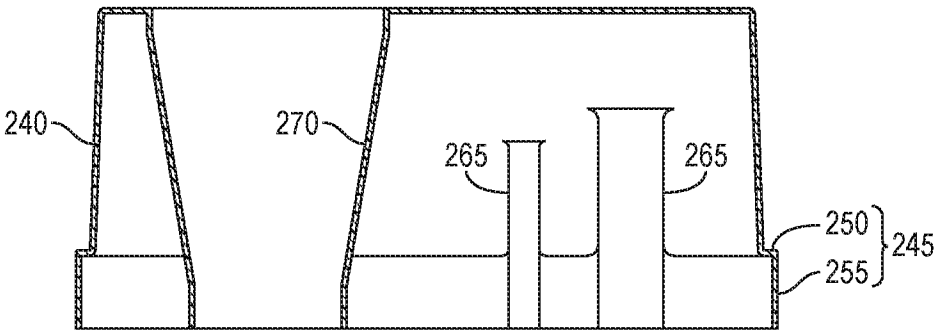
FIG. 4 is a cross-sectional view of a portion of a fluid feed system cover, taken along the line A-A of FIG. 3, according to an embodiment of the present invention.
Figure 5:
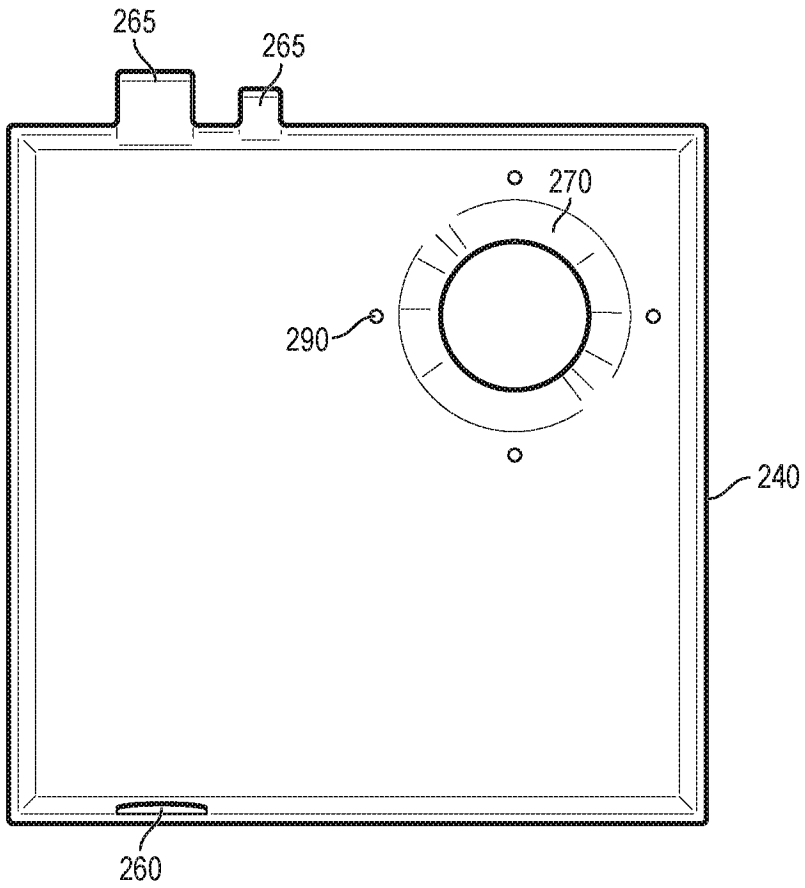
FIG. 5 is a bottom view of a fluid feed system cover, according to an embodiment of the present invention.

FIGS. 3 and 5 show the system cover 240, with the manway 275 removed. FIG. 4 shows a cross section of the system cover 240, with the manway 275, the manway seat 280, and the threaded fasteners 290 removed. In the embodiment of FIGS. 3-5, the funnel 270 has the shape of a vertically-oriented truncated cone, with the narrow end of the cone at the bottom, and with a short cylindrical section at each of the top and the bottom of the truncated cone. In other embodiments, the funnel 270 may have a different shape; for example, it may be tubular, it may have a cross section that is not circular, it may be sloped, or it may have the shape of a chute or sloping channel. As used herein, the term "funnel" refers to any sloping or vertical conduit for fluid. The funnel 270 may be an integral element formed as part of the system cover 240 when the system cover 240 is fabricated (as in the embodiment of FIGS. 3-5) or it may be a separately fabricated or purchased component secured to the system cover 240 after the system cover 240 is fabricated. In some embodiments the manway seat 280 is an integral part of the system cover 240, or the manway seat 280 is an integral part of the funnel 270, and the integrated funnel 270 and manway 275 are fabricated separately from the system cover 240 and subsequently secured to the system cover 240, e.g., with a weld or with adhesive.

When the replenishment of the reservoir 210 is complete, the manway 275 is reinstalled. The manway 275 keeps dirt or other contaminants out of the reservoir 210 and off of the interior surface of the funnel 270. The outer diameter of the funnel 270 may be selected to be a close fit to the fill hole 235 when the system cover 240 is installed on the reservoir 210 (i.e., the gap between the funnel 270 and the edge of the fill hole 235 may be relatively small), to reduce the risk of contaminants, such as dust, debris, or water, entering the reservoir 210 through the gap between the funnel 270 and the fill hole 235. In one embodiment rubber edge trim is installed on the edge of the fill hole 235 to provide a seal against the outer surface of the funnel 270 when the system cover 240 is installed.

The system cover 240 may be made of any of a variety of materials that are compatible with the fluid (e.g., glycol) for which the feed system is to be used and from which the system cover 240 may be fabricated by a cost-effective process. Linear low-density polyethylene (LLPE or LLDPE), high-density polyethylene (HDPE), polypropylene, or another polymer may be used. LLPE may be compatible with (i.e., resistant to) a variety of chemicals and may have less of a tendency to become brittle than polypropylene. The system cover 240 is fabricated by any of a number of processes suitable for forming the material into the shape of the system cover 240. In one embodiment, the system cover is formed out of LLPE by rotational molding; in this embodiment a recess in the shape of the window 260 may be formed during the rotational molding process and subsequently used to align a cutting tool that creates the window 260. Other candidate fabrication processes include thermal forming (which may also be referred to as vacuum forming), or thermal welding. In one embodiment the overall height of the system cover 240 (excluding the manway seat 280 and the manway 275) is 6.63 inches; the overall width of the system cover 240 is 14.50 inches, and the overall depth of the system cover 240 is 14.50 inches.

The lower end of the funnel 270 extends slightly into the fill hole 235 when the system cover 240 is installed on the reservoir 210. In other embodiments, the lower end of the funnel 270 is just above the fill hole 235 when the system cover 240 is installed. A tapered funnel 270, like the one of FIGS. 3-5, may be used with a fill hole 235 that is smaller than the upper opening of the funnel 270, and that consequently leaves a larger area on the top surface of the reservoir 210 for the equipment.

In one embodiment, a manway seat 280 is secured to the system cover 240, at the junction between the top surface of the system cover 240 and the funnel 270, with threaded fasteners 290. For example, each of four machine screws 290 may be inserted through a respective pair of aligned clearance holes in the manway seat 280 and in the system cover 240, and may engage a nut on the underside of the system cover 240. Other methods may be used to secure the manway seat 280 to the system cover 240, including solvent welding, or fastening with adhesive. The use of solvent welding or fastening with adhesive may be difficult with some materials, and, for example, a low-energy material such as LLPE may not be well suited for use with either of these processes.

The manway 275 may thread into the manway seat 280. In the embodiment of FIGS. 3-5, the interior surface of the manway seat 280 has two threads, in the form of two opposing helical ridges each extending about one-quarter of the way around the circumference of the manway seat 280. The manway 275 has corresponding threads or ridges for engaging the threads of the manway seat 280. The manway 275 is installed by turning it to engage the threads, until the manway 275 bottoms out on the manway seat 280. In other embodiments, the manway 275 may be secured to the manway seat 280 by a bayonet lock, by friction, or by gravity. A commercially available manway, such as a 4-inch manway available from Ronco Plastics, of Tustin, Calif., may be used.

The use of a manway 275 procured together with a corresponding manway seat 280 may simplify the interface between the system cover 240 and the manway 275, e.g., to four clearance holes. As a result, the manufacturer of the manway 275 and manway seat 280 may change the design of the interface between the manway 275 and manway seat 280 without requiring a change in the design of the system cover 240, if the hole pattern in the manway seat 280 remains unchanged.

In another embodiment, a tapered plug such as a WW-1064 tapered plug or a WWX-1063 tapered plug, both available from Caplugs of Buffalo, N.Y., may be used to plug the top of the funnel. Such a plug may engage the interior surface of the funnel directly, and be held in place by friction, without requiring a separate seat. A friction fit plug, however, may be more vulnerable to being accidentally dislodged than a manway secured in place by threads engaging a manway seat.

The manway 275 may be vented so that the withdrawal, by the pump 215, of fluid from the reservoir 210 does not produce a partial vacuum in the space above the fluid. In one embodiment the manway 275 has two positions, a partially closed "vent" position in which it is partially threaded into the manway seat 280, and a fully closed position in which it forms a seal against the manway seat 280. The manway 275 may also have a baffled internal passage that acts as a vent while providing a barrier to debris. The interface between the outer surface of the funnel 270 and the perimeter of the fill hole 235 (which may be a small gap or rubber edge trim) may form a loose seal that, although it reduces the risk of contaminants entering the reservoir, is not perfectly hermetic and thus may also function as a reservoir vent.

A feed system having a system cover 240 with an integrated funnel 270 may be suitable for use in other applications than as a glycol feed system, or as a feed system for a closed-loop fluid system. For example, a biocide feed system may be used for feeding biocide into a hydronic system. As another example, a chlorine metering system for supplying chlorine solution to a swimming pool may employ the same or a similar design. If the reservoir 210 is used to hold a toxic or corrosive chemical, the integrated funnel 270 may reduce the risk of exposure to the chemical that may otherwise exist, if a service technician holds a funnel 270 with one hand while pouring chemical into the funnel 270 with the other.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major component" means a component constituting at least half, by weight, of a composition, and the term "major portion", when applied to a plurality of items, means at least half of the items.

As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Although exemplary embodiments of a cover with integrated funnel have been specifically described and illustrated herein, many modifications and variations will be apparent to those skilled in the art. Accordingly, it is to be understood that a cover with integrated funnel constructed according to principles of this invention may be embodied other than as specifically described herein. The invention is also defined in the following claims, and equivalents thereof.

What is claimed is:

1. A fluid feed system, comprising:

a reservoir having an upper surface and a fill hole in the upper surface;

a system cover, the system cover comprising a funnel, the funnel having an upper opening at an upper surface of the system cover, and a lower opening, the lower opening being above the fill hole or inside the reservoir when the system cover is installed on the reservoir; and fluid-handling equipment under the system cover and secured to the upper surface of the reservoir.

2. The system of claim 1, wherein the system cover has a window configured to provide access to the fluid-handling equipment.

3. The system of claim 1, further comprising:

an electrical cable or a fluid line, wherein the system cover further comprises a connection channel, and the electrical cable or fluid line passes through the connection channel.

4. The system of claim 1, wherein the lower opening of the funnel is inside the reservoir.

5. The system of claim 1, wherein the fill hole of the reservoir has an edge, the system further comprising rubber edge trim on the edge of the fill hole of the reservoir.

6. The system of claim 1, further comprising a funnel cover covering the upper opening of the funnel.

7. The system of claim 6, further comprising a seat secured to the system cover at the upper opening of the funnel, the seat engaging and securing the funnel cover.

8. The system of claim 7, wherein the seat comprises an internal thread and the funnel cover comprises an external thread engaging the internal thread of the seat.

9. The system of claim 7, wherein the seat is secured to the system cover with a plurality of threaded fasteners.

10. The system of claim 7, wherein the seat is an integral part of the system cover.

11. The system of claim 6, wherein the funnel cover is a tapered plug that fits into the upper opening of the funnel.

12. The system of claim 6, wherein the funnel cover has a vent providing an air path from an upper side of the funnel cover to a lower side of the funnel cover.

13. The system of claim 1, wherein a cross-sectional area of the upper opening of the funnel is greater than a cross-sectional area of the lower opening of the funnel.

14. The system of claim 1, wherein a portion of the funnel is a hollow truncated cone.

15. The system of claim 1 wherein the funnel is an integral part of the system cover.

16. The system of claim 1, wherein the system cover comprises, as a major component, a material selected from the group consisting of linear low-density polyethylene, high-density polyethylene, and polypropylene.

17. The system of claim 1, further comprising a horizontal shelf that abuts against a horizontal surface of the reservoir.

* * * * *